US008147240B2

(12) United States Patent
Lyons et al.

(10) Patent No.: US 8,147,240 B2
(45) Date of Patent: Apr. 3, 2012

(54) THIN CHAMBER BURNER

(75) Inventors: David C. Lyons, Red Wing, MN (US); Travis P. Betcher, Goodhue, MN (US); Louis L. Mead, Lake City, MN (US)

(73) Assignee: HNI Technologies Inc., Muscatine, IA (US)

( * ) Notice: Subject to any disclaimer, the term of this patent is extended or adjusted under 35 U.S.C. 154(b) by 221 days.

(21) Appl. No.: 12/405,842

(22) Filed: Mar. 17, 2009

(65) Prior Publication Data

US 2010/0239990 A1 Sep. 23, 2010

(51) Int. Cl.

| | |
|---|---|
| ***F23Q 2/32*** | (2006.01) |
| ***F23D 14/46*** | (2006.01) |
| ***F23D 14/62*** | (2006.01) |
| ***F23C 7/00*** | (2006.01) |
| ***F24B 1/18*** | (2006.01) |

(52) U.S. Cl. ..... 431/125; 431/350; 431/351; 431/354; 126/500; 126/512

(58) Field of Classification Search ..... 431/125, 431/350, 351, 354; 126/500, 512
See application file for complete search history.

(56) References Cited

U.S. PATENT DOCUMENTS

| | | | | |
|---|---|---|---|---|
| 3,314,610 | A | 4/1967 | Reznor | |
| 3,831,582 | A | 8/1974 | Mahoney | |
| 4,149,447 | A * | 4/1979 | Wiedermann | 86/50 |
| 4,637,372 | A | 1/1987 | Mogol et al. | |
| 5,057,008 | A | 10/1991 | Dielissen | |
| 5,479,916 | A | 1/1996 | Shimek et al. | |
| 5,645,409 | A | 7/1997 | Ni et al. | |
| 5,647,340 | A | 7/1997 | Shimek et al. | |
| 5,722,824 | A | 3/1998 | Beck | |
| 5,947,112 | A | 9/1999 | Hawkinson | |
| 6,036,474 | A | 3/2000 | Diep et al. | |
| 6,053,165 | A * | 4/2000 | Butler et al. | 126/512 |
| 6,095,794 | A | 8/2000 | Jamieson et al. | |
| 6,170,481 | B1 | 1/2001 | Lyons et al. | |

(Continued)

FOREIGN PATENT DOCUMENTS

BE 471362 A 2/1947

(Continued)

OTHER PUBLICATIONS

Installation and Operation Manual for Lennox Hearth Products, Catalytic Vent-Free, Wall-Mounted Gas Fireplace, Models: Radium-NG and Radium-LP P/N 850,054M Rev. F, May 2009, 20 pages.

(Continued)

*Primary Examiner* — Kenneth Rinehart
*Assistant Examiner* — William Corboy
(74) *Attorney, Agent, or Firm* — Faegre Baker Daniels LLP

(57) ABSTRACT

A gas burner assembly includes a first sheet, a second sheet, and a conduit. The first sheet has an inner face, an outer face, an upper portion, and a lower portion. The second sheet also has an inner face, an outer face, an upper portion and a lower portion. The first and second sheets are secured relative to one another such that the first and second sheets are separated by a gap that defines a manifold between the inner faces of the first and second sheets with an elongate opening between the upper portions of the first and second sheets, the opening forming an outlet from the manifold. The conduit is in communication with the manifold, the conduit being adapted for connection to a source of gas.

13 Claims, 9 Drawing Sheets

U.S. PATENT DOCUMENTS

| | | | | |
|---|---|---|---|---|
| 6,371,753 | B1 | 4/2002 | O'Donnell et al. | |
| 6,601,579 | B2 * | 8/2003 | Fier et al. | 126/512 |
| 6,916,174 | B2 | 7/2005 | O'Donnell et al. | |
| 7,077,122 | B2 | 7/2006 | Lyons et al. | |
| 7,101,174 | B2 | 9/2006 | Tomiura et al. | |
| 2003/0143507 | A1 * | 7/2003 | Kuriyama et al. | 431/354 |
| 2005/0227194 | A1 * | 10/2005 | Weinberger | 431/331 |
| 2006/0185664 | A1 | 8/2006 | Butler et al. | |

FOREIGN PATENT DOCUMENTS

| | | | |
|---|---|---|---|
| DE | 2605954 | A1 | 8/1976 |
| EP | 0352342 | A1 | 1/1990 |

OTHER PUBLICATIONS

Installation and Operating Instructions for Napoleon Quality Fireplaces, Models LHD50N and LHD 50NS Natural Gas, Models LHD50P and LHD50P2 Propane, 59 pages.

SPARK Modern Fires, Web brochure, SPARK Linear Burner System Indoor, www.sparkfires.com Accessed Oct. 30, 2008, (2 pgs.).

International Search Report and Written Opinion issued in PCT/US2010/025235, mailed Dec. 29, 2011.

* cited by examiner

THIN CHAMBER BURNER

BACKGROUND

Gas burners are used in gas fireplace units for producing flames for visual effect and/or heating purposes. Typically, gas burners are used to combust a gas/air mixture thereby producing flames. Often times, gas burners are designed to produce flames that mimic an appearance of a natural, wood burning fire. More common gas burners include tube burners and pan burners. Although the tube- and pan-designs are common, other designs have become more common—including gas burners shaped to mimic an appearance of wood log, for example.

SUMMARY

Some of the inventive aspects described herein relate to a gas burner having a high degree of versatility in flame presentation, including, for example, the ability to hide various portions of the burner, produce various flame effects, and provide a slimmer burner. The versatility of various embodiments described herein allows greater freedom in fireplace design and flame presentation.

In some embodiments, a gas burner assembly includes a first sheet, a second sheet, and a conduit. The first sheet has an inner face, an outer face, an upper portion, and a lower portion. The second sheet also has an inner face, an outer face, an upper portion and a lower portion. The first and second sheets are secured relative to one another such that the first and second sheets are separated by a gap that defines a manifold between the inner faces of the first and second sheets with an elongate opening, or outlet, between the upper portions of the first and second sheets, the opening forming an outlet from the manifold. The conduit is in communication with the manifold, the conduit being adapted for connection to a source of gas.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

Figure 1:
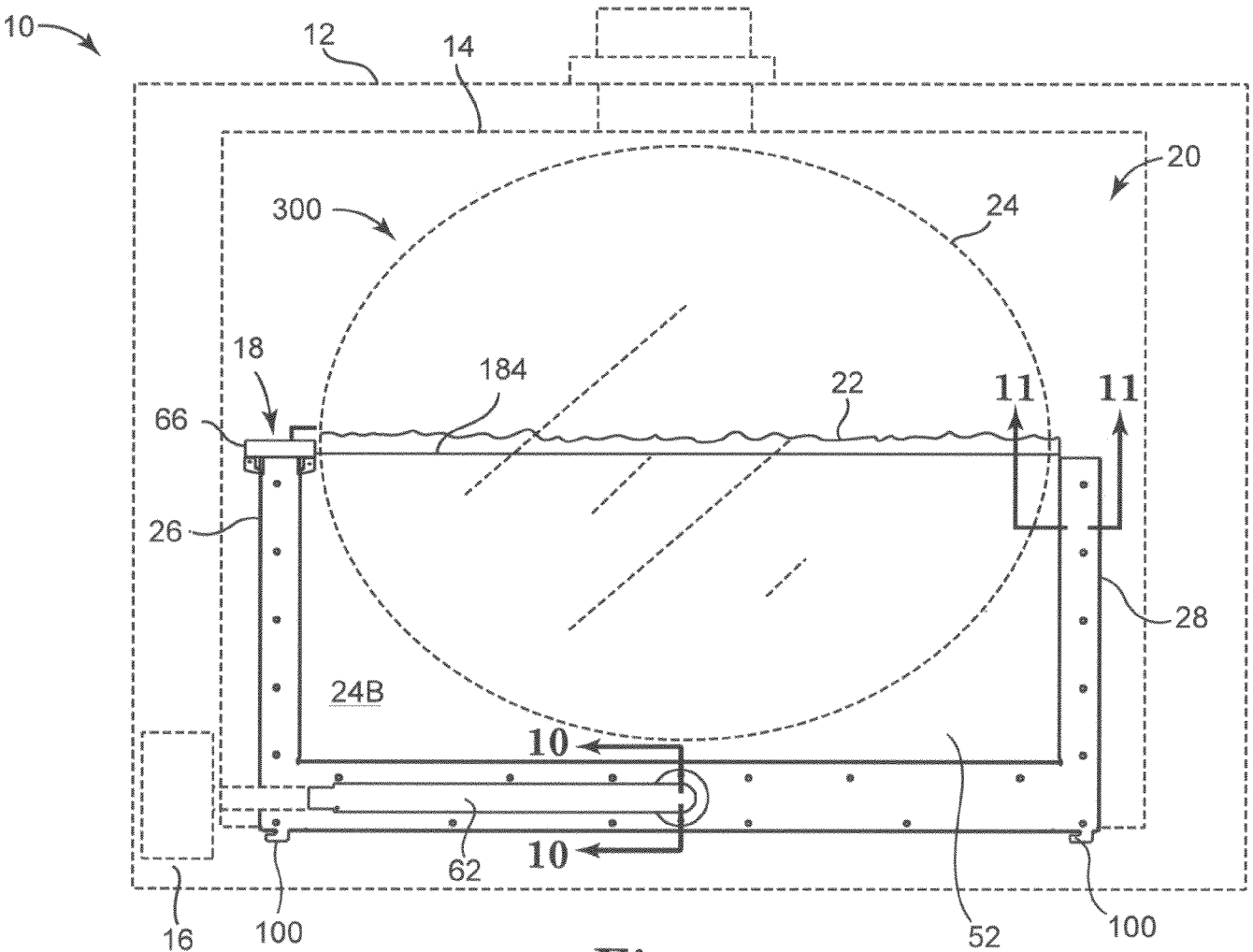
FIG. 1 is a front view of a fireplace including a burner assembly, according to some embodiments.

While the invention is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives failing within the scope of the invention as defined by the appended claims.

DETAILED DESCRIPTION

Some of the inventive aspects described herein relate to a gas burner having a high degree of versatility in flame presentation in a heating unit such as a fireplace, including, for example, the ability to hide various portions of the burner assembly, produce various flame effects, and/or provide a slimmer, vertically-oriented burner assembly. The versatility of various embodiments described herein helps provide greater freedom in fireplace design and flame presentation. Although embodiments having the above-described features are provided herewith, additional or alternative features and associated advantages are also made apparent.

FIG. 1 is a front view of a fireplace 10 including an outer housing 12, a combustion chamber 14, a gas source 16, and a burner assembly 18. For ease of illustration, the outer housing 12, combustion chamber 14, and gas source 16 are shown in broken lines.

The outer housing 12 is formed of any of a variety of suitable materials, including sheet metals, for example. Likewise, the combustion chamber 14 is formed of any of a variety of suitable materials, including molded ceramic fiber and binder composites, for example. The combustion chamber 14 defines a combustion enclosure 20 adapted to receive heat and combustion products from flames 22 produced by the burner assembly 18. The combustion chamber 14 includes a transparent front portion 24 (e.g., one or more sheets of transparent glass) for viewing into the combustion enclosure 20, as well as a transparent rear portion (not shown) as desired. In some embodiments, the combustion chamber 14 includes additional transparent portions (e.g., side, back, etc.) for viewing into the combustion enclosure 20.

The gas source 16 is optionally a regulator connected to an external gas line (not shown), such as a natural gas or LP gas line associated with residential, commercial, or other structure. Other gases are also contemplated, such as hydrogen, for example. In general terms, the burner assembly 18 of the fireplace 10 is adapted to direct flames into the combustion enclosure 20 of the combustion chamber 14.

Additional or alternative fireplace components associated materials, and configurations suitable for use in association with the burner assembly 18 are provided in various products offered by Hearth and Home Technologies, Inc. of Minnesota. As examples of patent literature, U.S. Pat. No. 5,016,609, entitled "Direct Vented Multi Glass Side Fireplace," U.S. Pat. No. 5,647,340, entitled "Convertible Dual Direct-Vented Fireplace," U.S. Pat. No. 5,947,112, entitled "Prefabricated Fireplace Exhaust Plenum Structure," U.S. Pat. No. 6,170, 481, entitled "Open Ended Molded Fireplace Box and Method," and U.S. Pat. No. 7,077,122, entitled "Reduced Clearance Gas Fireplace," the entire contents of all of which are incorporated herein by reference, provide descriptions of additional or alternative fireplace components associated materials, and configurations suitable for use with the burner assembly 18, according to some embodiments.

Figure 2:
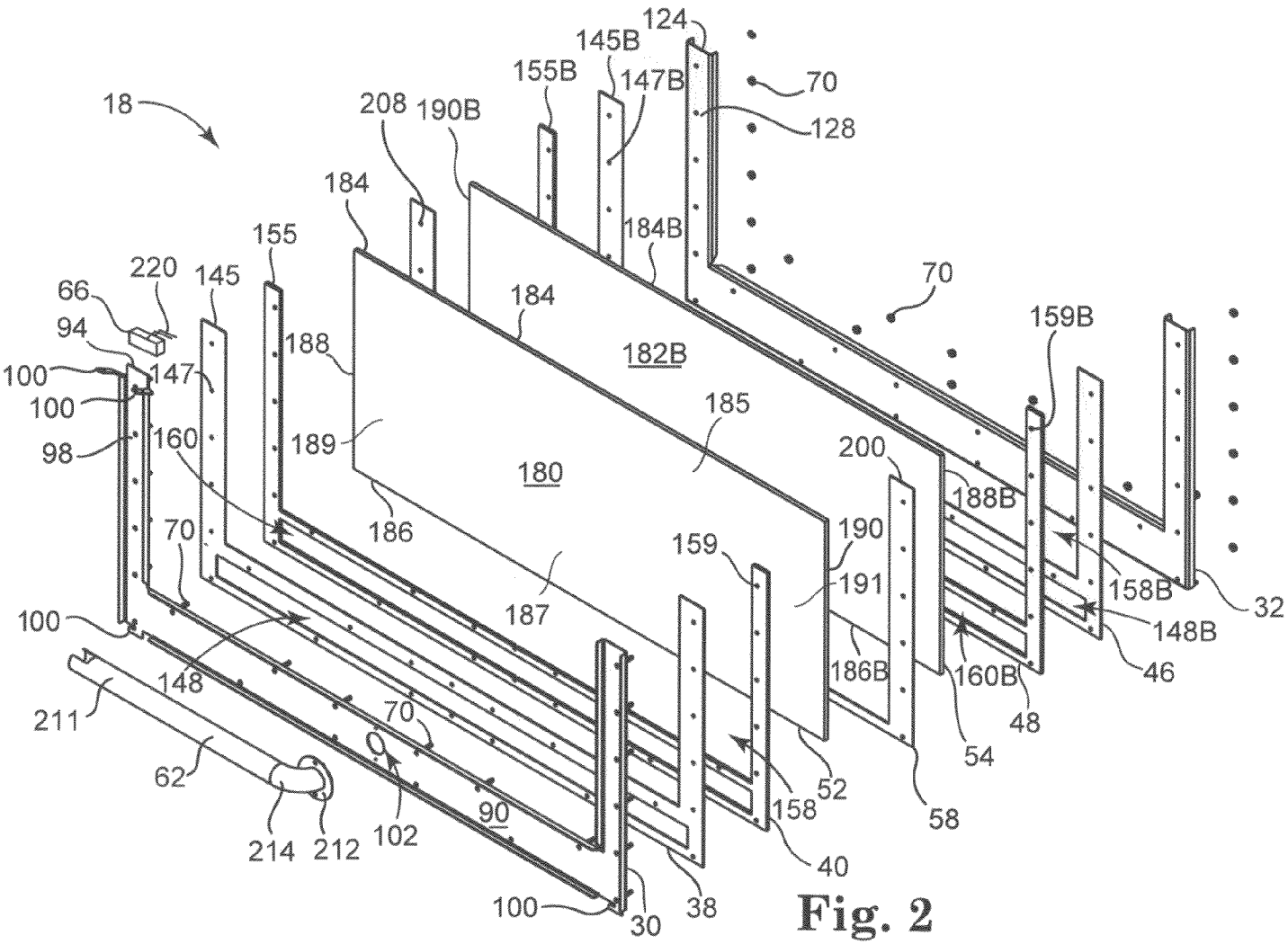
FIG. 2 is a perspective view of the burner assembly of FIG. 1 in an unassembled state, according to some embodiments.

As shown in FIG. 1, the burner assembly has a first side 26 and a second side 28. In some embodiments, the burner assembly is about 37 inches wide, about 17 inches in height, and about 1.55 inches thick, although a variety of dimensions are contemplated. FIG. 2 shows the burner assembly 18 in an unassembled state, according to some embodiments. As shown in FIG. 2, the burner assembly 18 includes a first frame member 30, a second frame member 32, a first intermediate seal 38, a first spacer 40, a second intermediate seal 46, a second spacer 48, a first plate 52, a second plate 54, an inner seal 58, a connector 62, an igniter 66, and a plurality of fasteners 70.

In some embodiments, various components of the burner assembly 18 are sandwiched together to form a thin, generally vertical structure with the fasteners 70 securing the structure together. Generally, the first and second frame members 30, 32 (as well as the seals 38, 46, 58 and spacers 40, 48) form an outer housing around the first and second plates 52, 54. As described in greater detail, the burner assembly 18 has an upper manifold 72 (FIG. 10) that is thin and oriented substantially vertically and a lower manifold 74 (FIG. 11) in communication with the upper manifold 72. The upper and lower manifolds 72, 74 are optionally described as closed plenums or chambers, for example.

Figure 3:
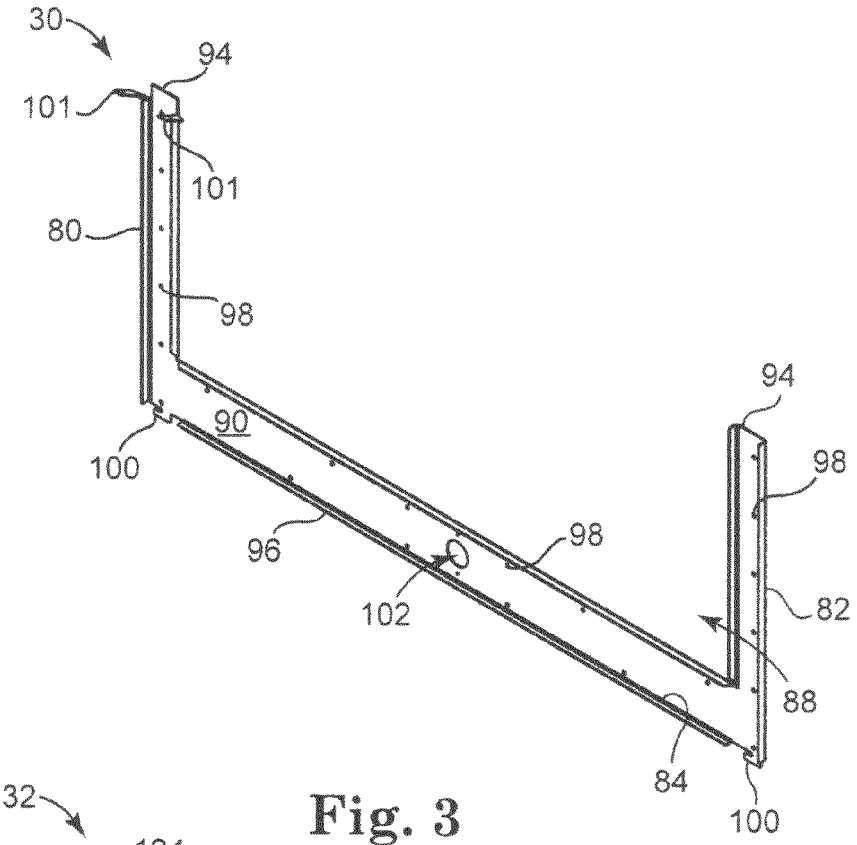
FIG. 3 is a perspective view of a first frame member of the burner assembly of FIG. 2.

FIG. 3 is a perspective view of the first frame member 30, according to some embodiments. As shown, the first frame member 30 includes a first upright 80, or first side portion, a second upright 82, or second side portion, and a lateral member 84 extending between the first and second uprights 80, 82, where the first upright 80, the second upright 82, and the lateral member 84 define a central viewing area 88. The first frame member 30 also defines an outer face 90, an inner face 92 (FIG. 10), an upper portion 94 and a lower portion 96, and has a plurality of fastener holes 98.

In some embodiments, the first frame member 30 includes a pair of feet 100 at the lower portion 96, of the first frame member 30 adapted for maintaining the burner assembly 18 (FIG. 1) in a substantially upright position (e.g., on a bottom portion of the combustion chamber 14). The inner face 92 of the first frame member 30 is optionally substantially planar overall. In some embodiments, the first upright 80 includes a pair of tabs 101 adapted to maintain the igniter 66. The lateral member 84 is optionally positioned at the lower portion 96 of the first frame member 30 and has an opening 102. In some embodiments, the opening 102 is about 1.25 inches in diameter.

Though a variety of materials and forming processes are contemplated, the first upright 80, the second upright 82, and the lateral member 84 are optionally formed from a single piece of sheet metal or other material using bending and/or stamping processes, for example. The first upright 80, the second upright 82, and the lateral member 84 combine to form a substantially U-shaped frame, where the central viewing area 88 is defined on three sides by the first upright 80, the second upright 82, and the lateral member 84 and is open at the upper portion 94.

Figure 4:
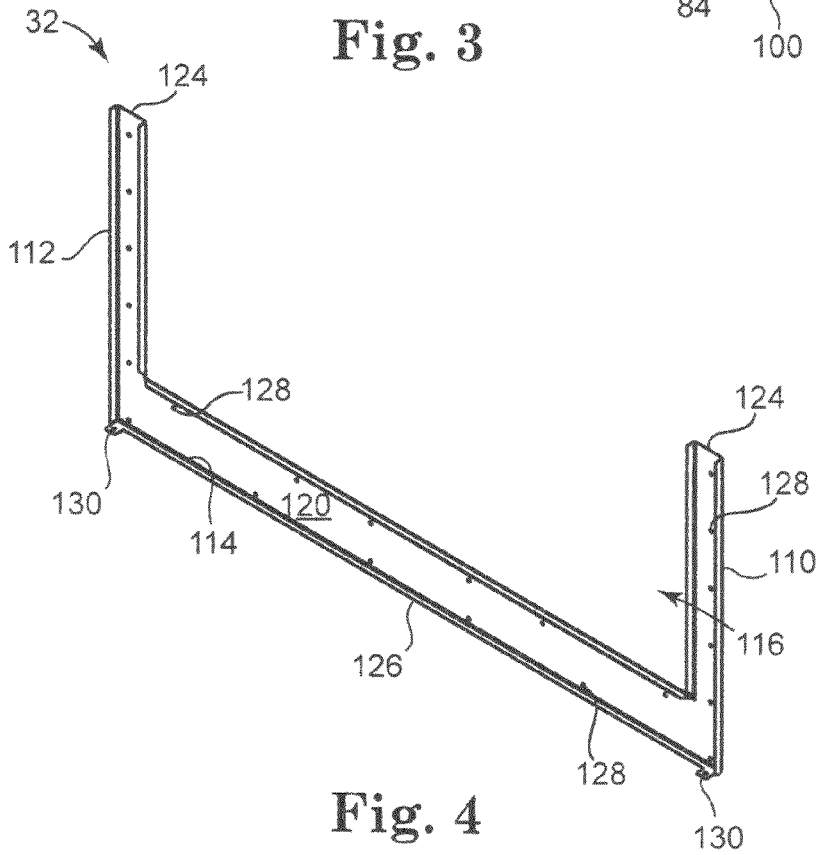
FIG. 4 is a perspective view of a second frame member of the burner assembly of FIG. 2.

FIG. 4 is a perspective view of the second frame member 32, according to some embodiments. As shown, the second frame member 32 is substantially complementary in configuration to the first frame member 30 and includes a first upright 110, or first side portion, a second upright 112, or second side portion, and a lateral member 114 extending between the first and second uprights 110, 112, where the first upright 110, the second upright 112, and the lateral member 114 define a central viewing area 116.

The second frame member 32 also defines an outer face 120, an inner face 122 (FIG. 10), an upper portion 124, and a lower portion 126 and has a plurality of fastener holes 128. The inner face 122 of the second frame member 32 is optionally substantially planar overall. The second frame member 32 includes a pair of feet 130 at the lower portion 96 of the second frame member 32 adapted for maintaining the burner assembly 18 (FIG. 1) in a substantially upright position (e.g., on the bottom portion of the combustion chamber 14). In some embodiments, similar forming processes and materials to those of the first frame member 30 are used to form the second frame member 32. The first upright 110, the second upright 112, and the lateral member 114 combine to form a substantially U-shaped frame, where the central viewing area 116 is defined on three sides by the first upright 110, the second upright 112, and the lateral member 114 and is open at the upper portion 124.

The various seals are shown and described below as preformed pieces (e.g., being molded, stamped, or cut out) of material. In some embodiments, however, one or more of the seals are deposited or applied as liquids or gels that cure or are otherwise formed.

Figure 5:
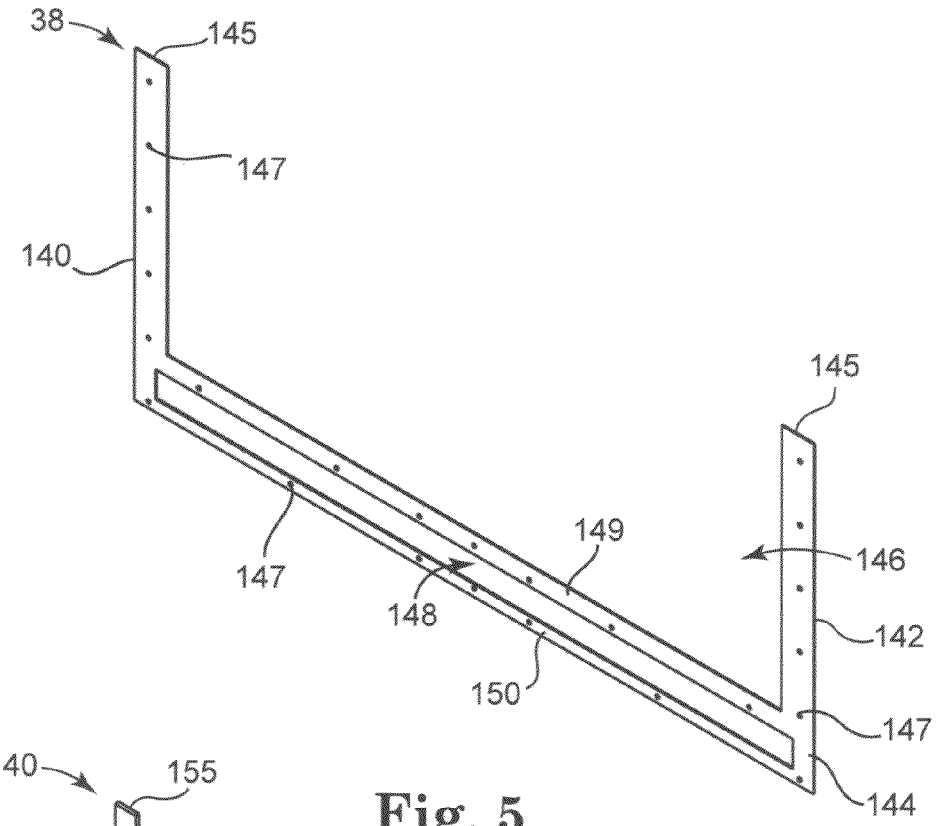
FIG. 5 is a perspective view of a first intermediate seal of the burner assembly of FIG. 2.

FIG. 5 is a perspective view of the first intermediate seal 38, according to some embodiments. The first intermediate seal 38 is optionally formed as a single piece of gasket material (e.g., high-temp silicone gasket material), or any other suitable material. In some embodiments, the first intermediate seal 38 is about 0.125 inches thick, although a variety of dimensions (e.g., from about 0.1 inches to about 0.8 inches thick) are contemplated. The first intermediate seal 38 includes a first arm 140, or first side portion, a second arm 142, or second side portion, and a lower body 144 connecting the first and second arms 140, 142. The first intermediate seal 38 also defines an upper portion 145. The first intermediate seal 38 is substantially U-shaped, for example, defining an open interior 146 bounded by the first arm 140, the second arm 142, and the lower body 144 and has a plurality of fastener holes 147 disposed about the first intermediate seal 38.

The lower body 144 has an opening 148 which, as described in greater detail below, helps provide means for forming a gas plenum. As shown, the opening 148 is substantially rectangular in shape and about 34.5 inches wide and from about 1 to about 3 inches tall (e.g., about 2 inches tall), although a variety of shapes and dimensions are contemplated. The lower body 144 has an upper piece 149 above the opening 148 and a lower piece 150 below the opening 148. The open interior 146 is sized to be substantially smaller than the first plate 52 such that the first arm 140, the second arm 142, and the upper piece 149 are sized to overlap the first plate 52 as described in greater detail below.

The second intermediate seal 46 is substantially similar to the first intermediate seal 38, according to some embodiments. As such, where features of the second intermediate seal 46 are described and shown they are designated by a similar reference number to the first intermediate seal 38 followed by a "B."

Figure 6:
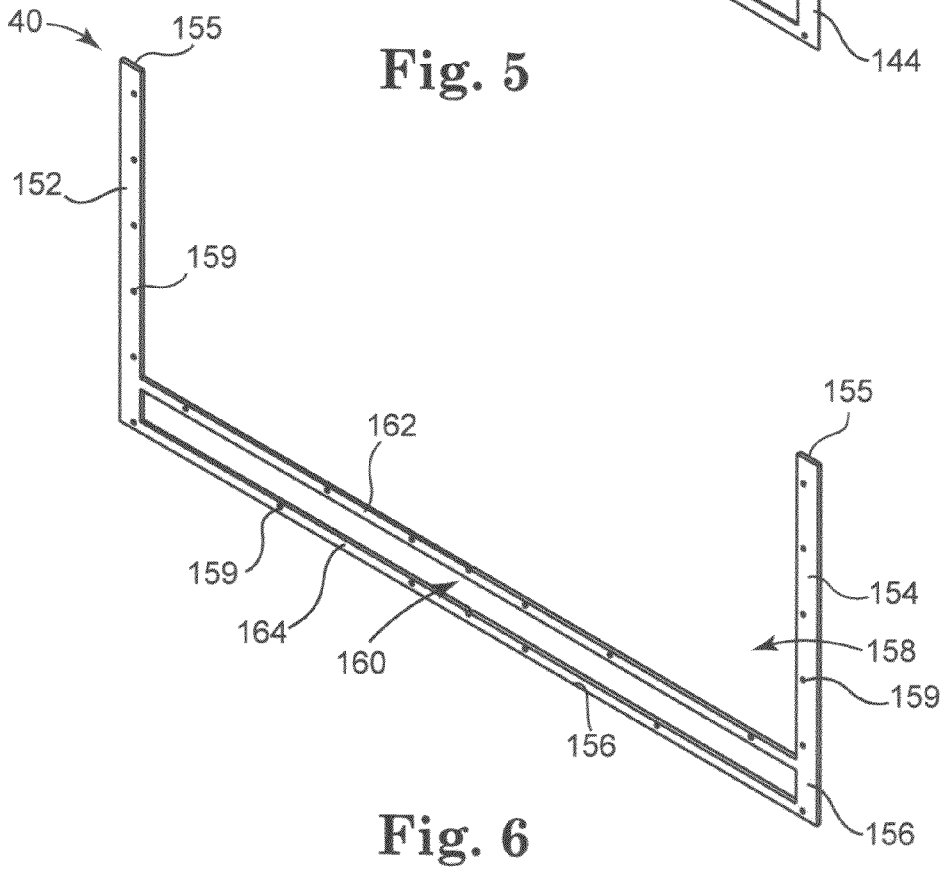
FIG. 6 is a perspective view of a first spacer of the burner assembly of FIG. 2.

FIG. 6 is a perspective view of the first spacer 40. The first spacer 40 is optionally formed as a single piece of material. In some embodiments, the first spacer 40 is adapted to support the first plate 52 and/or to provide anchor points for fastening the various burner components together without unduly stressing the first plate 52. For example, the first spacer 40 is formed of steel or another sufficiently rigid material (e.g., polymeric or metallic materials) for supporting the first plate 52 and/or providing suitable assembly anchor points. In some embodiments, the first spacer 40 is about 0.25 inches thick, although a variety of dimensions are contemplated (e.g., from about 0.1 to about 0.5 inches thick). In some embodiments, the first spacer 40 has about the same thickness as the first plate 52.

The first spacer 40 includes a first arm 152, or first side portion, a second arm 154, or second side portion, and a lower body 156 connecting the first and second arms 152, 154. The first spacer 40 also has an upper portion 155. In some embodiments, the first spacer 40 is substantially U-shaped, defining an open interior 158 bounded by the first arm 152, the second arm 154, and the lower body 156. The open interior 158 is sized to be substantially complementary in size to the first plate 52, such that the first plate 52 is able to be received in the open interior 158 in a substantially complementary fit. The first spacer 40 also includes a plurality of fastener holes 159 disposed about the first spacer 40.

The lower body 156 has an opening 160 which, as subsequently described, helps provide means for forming a lower manifold, or plenum of the burner assembly 18. As shown, the opening 160 is substantially rectangular in shape and about 34.5 inches wide and about 2 inches high, although a variety of shapes and dimensions are contemplated (e.g., from about 1 inch to about 3 inches in height). The lower body 156 defines an upper piece 162 above the opening 160 and a lower piece 164 below the opening 160.

The second spacer 48 is substantially similar to the first spacer 40, according to some embodiments. As such, where features of the second spacer 48 are described and shown they are designated by a similar reference number to the first spacer 40 followed by a "B."

As shown in FIG. 2, in some embodiments, the first plate 52 is substantially rectangular in shape, having a width of about 35 inches, a height of about 14 inches, and a thickness of about 0.25 inches, although a variety of dimensions are contemplated (e.g., a plate thickness from 0.1 to about 0.5 inches). The first plate 52 is optionally formed of ceramic glass, or other suitable material. In some embodiments, the first plate 52 is formed of a substantially transparent, or see-through material (e.g., ceramic glass) such that light is able to pass through the first plate 52. In other embodiments, the first plate 52 is formed of substantially reflective material (e.g., a material such as Mirropane™ available from Toledo—Pilkington North America Inc. of Toledo, Ohio) or other materials. In still other embodiments, the first plate 52 is formed of opaque materials, such as marble, sheet metal, or others. The first plate 52 defines an outer face 180, an inner face 182 (FIG. 10), a top edge 184 along an upper portion 185 of the first plate 52, a bottom edge 186 along a lower portion 187 of the first plate 52, a first side edge 188 along a first side portion 189 of the first plate 52, and a second side edge 190 along a second side portion 191 of the first plate 52.

In some embodiments, the inner and/or outer faces 180, 182 of the first plate 52 are substantially planar, where the inner and/or outer faces 180, 182 are optionally smooth (e.g., as with typical sheet glass) or include surface features (e.g., bumps, ridges, dimpling, facets, or other features) while being considered substantially planar. In some other embodiments, the inner and/or outer faces 180, 182 are not substantially planar (e.g., including larger-scale waves or bends). For example, the first and second plates 52, 54 are optionally substantially S-shaped and fit together, at a spaced relationship, in a complementary manner.

The second plate 54 is optionally substantially similar to the first plate 52, according to some embodiments. As such, where features of the second plate 54 are described and shown they are designated by a similar reference number to the first plate 52 followed by a "B." Each of the first and second plates are optionally described as panels, planer members, or sheets as desired.

Figure 7:
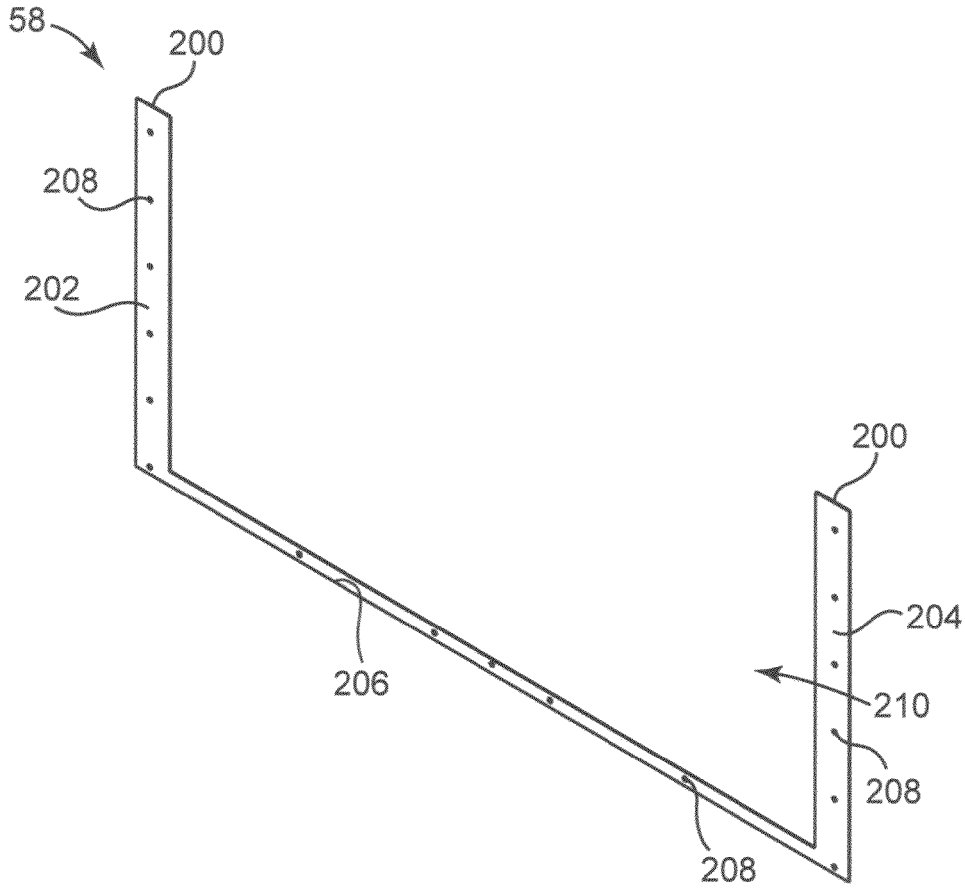
FIG. 7 is a perspective view of an inner seal of the burner assembly of FIG. 2.

FIG. 7 is a perspective view of the inner seal 58, according to some embodiments. The inner seal 58 is optionally formed as a single piece of gasket material, or any suitable material (e.g., high temp silicone gasket material). In some embodiments, the inner seal 58 is about 0.06 inches thick, although a variety of dimensions are contemplated (e.g., from about 0.03 inches to about 0.250 inches thick). The inner seal 58 has an upper portion 200 and includes a first arm 202, or first side portion, a second arm 204, or second side portion, and a lower body 206 connecting the first and second arms 202, 204. The inner seal 58 also includes a plurality of fastener holes 208 disposed about the inner seal 58.

The inner seal 58 is substantially U-shaped, defining an open interior 210 bounded by the first arm 202, the second arm 204, and the lower body 206. The open interior 210 is sized to be less wide than the first and second plates 52, 54 such that the first and second arms 202, 204 are sized to abut the first and second plates 52, 54 upon assembly of the burner assembly 18. In turn, the open interior 202 is substantially taller in height than the first plate 52 to leave space under the first and second plates 52, 54. In particular, the first and second arms 202, 204 are adapted to overlap the first plate 52 while the lower body 206 resides below the first and second plates 52, 54 at an offset from the bottom edges 186, 186B of the first and second plates 52, 54. In some embodiments, the lower body 206 is about 0.6 inches in height, for example.

As shown in FIG. 2, in some embodiments the connector 62, also described as a conduit, includes a tubular, hollow body 211, or tubular member, and a flange 212 secured at one end of the body 211. The body 211 includes an elbow bend 214 proximate the flange 212 and is slotted at an opposite end, for example, to facilitate use of an air-to-gas mixture control means.

As shown in FIG. 2, in some embodiments the igniter 66 includes a spark generation probe or probes 220 and is generally adapted to ignite combustible gases and gas/air mixtures. The igniter 66 is adapted to be mounted to the pair of tabs 101 of the first frame member 30. The igniter 66 is connected to a suitable power source and controller (not shown) for timing and other ignition system control.

Figure 8:
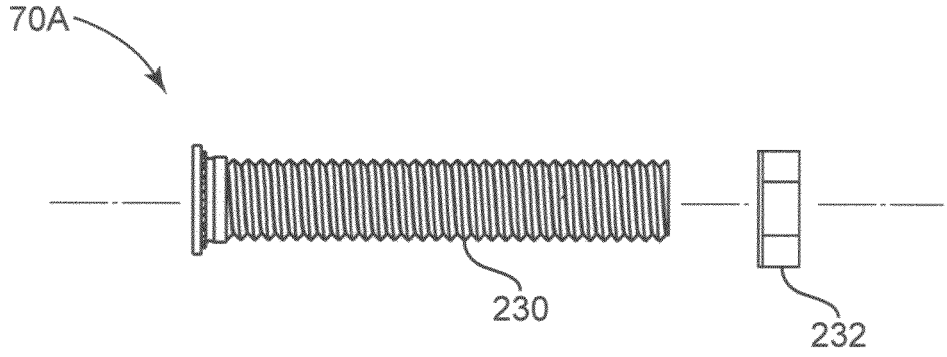
FIG. 8 is a side view of a fastener of the burner assembly of FIG. 2.

FIG. 8 shows a first fastener 70A of the plurality of fasteners 70. As shown, the first fastener 70A includes a body portion 230 and a complementary head portion 232. The first fastener 70A is optionally adapted to be self locking and secured in a bolt-and-nut fashion, though a variety of fasteners including adhesives, for example, are also contemplated. Each of the plurality of fasteners 70 is optionally substantially similar to the first fastener 70A, according to some embodiments.

Figure 9:
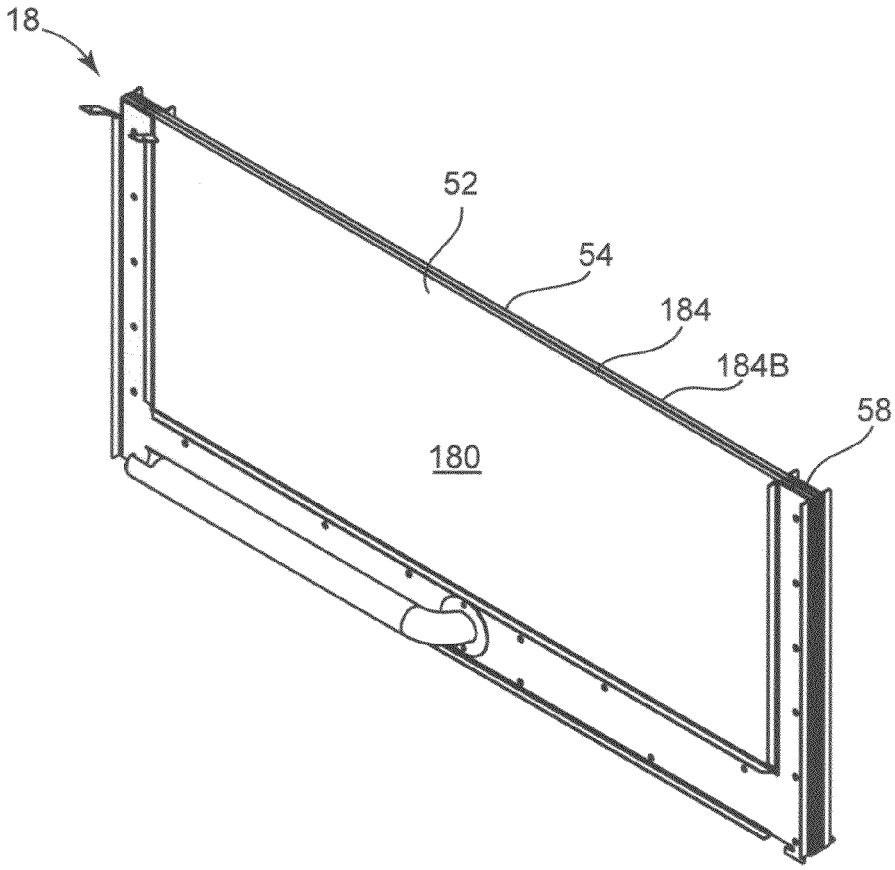
FIG. 9 is a perspective view of the burner assembly of FIG. 2 in an assembled state.
Figure 10:
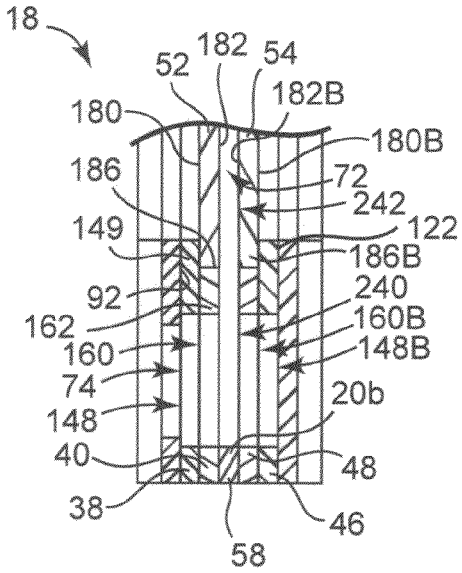
FIG. 10 is a cross-sectional view of a portion of the burner assembly along line 10-10 of FIG. 1.
Figure 11:
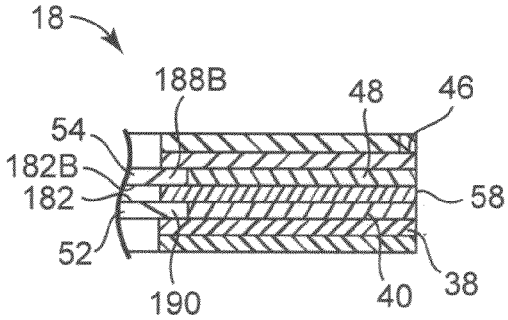
FIG. 11 is a cross-sectional view of a portion of the burner assembly along line 11-11 of FIG. 1.

FIG. 9 is a perspective view of the burner assembly 18 of FIG. 2 in an assembled state. FIG. 10 is a cross-sectional view of a portion of the burner assembly 18 without the connector 62 along line 10-10 shown in FIG. 1 and FIG. 11 is another cross-sectional view of a portion of the burner assembly 18 along line 11-11 shown in FIG. 1. Reference can be made between the unassembled, exploded view of FIG. 2 and the assembled views of FIGS. 9-11 as appropriate to assist in understanding some methods of assembling the burner assembly 18.

In some embodiments, assembly includes disposing the first and second plates 52, 54 in a substantially parallel, spaced relationship with the inner seal 58 disposed between the first and second plates 52, 54. The inner seal 58 is optionally substantially compliant and helps reduce the effects of irregularities, misalignment, and/or stress concentrations on the plates 52, 54. Where the plates 52, 54 are formed of glass or other ceramic material, such compliance is useful to prevent cracking of the plates 52, 54, although the first and second spacers 40, 48 also optionally assist in this regard.

In some embodiments, the inner seal 58 is abutted against the inner face 182 of the first plate 52 and inner face 182B of the second plate 54, respectively such that the inner seal 58 runs along the first and second side edges 188, 190 of the first plate 52 and first and second side edges 188B, 190B of the second plate 54. The upper portion 200 of the inner seal 58, the top edge 184 of the first plate 52, and top edge 184B of the second plate 54 are substantially aligned with one another and the lower body 206 of the inner seal 58 is positioned below the bottom edge 186 of the first plate and bottom edge 186B of the second plate 54 to define an opening 240 forming part of the lower manifold 74 and being in communication with the upper manifold 72 as shown in FIG. 10.

In some embodiments, the first spacer 40 receives the first plate 52 in the open interior 158 (FIG. 2) of the first spacer 40. In turn, the second spacer 48 similarly receives the second plate 54 in the open interior 158B (FIG. 2) of the second spacer 48. In some embodiments, the first and second plates 52, 54 generally rest on the first and second spacers 40, 48, respectively. The plates 52, 54 and spacers 40, 48, respectively, form a generally complementary fit as desired, although some play or tolerance is optionally provided in such a fit to account for thermal expansion, assembly misalignment, or other considerations.

In some embodiments, the first intermediate seal 38 is abutted against the outer face 180 of the first plate 52, as well as the first spacer 40, and the second intermediate seal 46 is abutted against the outer face 180B of the second plate 54, as well as the second spacer 48. In particular, the intermediate seals 38, 46 are abutted against the first and second plates 52, 54, respectively, toward the outer perimeters of each of the first and second plates 52, 54. The upper portion 145 of the first intermediate seal 38 and the upper portion 145B of the second intermediate seal 46 are generally aligned with the top edges 184, 184B of the first and second plates 52, 54, respectively. In turn, the openings 148, 148B of the first and second intermediate seals 38, 46 are generally aligned with each other and are positioned below the bottom edges 186, 186B of the first and second plates 52, 54.

As shown in FIG. 10, in some embodiments, the openings 148, 148B of the first and second intermediate seals 38, 46; the openings 160, 160B of the first and second spacers 40, 48; and the opening 240 combine to define the lower manifold 74 and the spacing, or gap 242, between the first and second plates 52, 54 defines the upper manifold 72. In some embodiments, the thickness of the inner seal 58 is selected to control the thickness of the gap 242. For example, the thickness of the inner seal 58 is optionally substantially uniform such that the gap 242 is substantially vertical in orientation and is substantially uniform, or continuous in thickness.

In some embodiments, the outer, side edges 188, 188B and 190, 190B are sealed such that a substantially thin, vertical chamber—the upper manifold 72—is formed between the first and second plates 52, 54; a thin, elongate inlet into the upper manifold 72 is formed, or otherwise defined, along the bottom edges 186, 186B of the first and second plates 52, 54; and an elongate outlet from the upper manifold 72 formed, or otherwise defined, along the top edges 184, 184B. In particular, a substantial perimeter portion of the first and second plates 52, 54 is sealed together to form the upper manifold 72 with the gap 242 defined between the first and second plates 52, 54.

In some embodiments, the gap 242 is substantially elongate and continuous at the top edges 184, 184B of the first and second plates 52, 54 to help define an elongate outlet from the burner assembly 18. The gap 242 is optionally substantially continuous between the first and second plates 52, 54 (from top-to-bottom and from side-to-side), although non-uniform spacing between the first and plates 52, 54 is also contemplated (e.g., a top profile of the gap 242 at the top edges 184, 184B is substantially thin and rectangular according to some embodiments, although sinusoidal, jagged, or other profiles are contemplated to modify flame shape and/or other flame and visual characteristics). In some embodiments, the gap 242 extends without interruption for a length of about 33.5 inches at the top edges 184, 184B at a thickness of about 0.06 inches, for example, although a variety of dimensions are contemplated. In some embodiments, the gap 242 is less than about 0.5 inches thick. In some other embodiments, a gap thickness from about 0.03 inches to about 0.125 inches is contemplated. A variety of lengths are also contemplated, including the gap 242 extending continuously without interruption from about 3 inches to about 48 inches, for greater than about 3 inches, greater than about 12 inches, or greater than about 24 inches, for example.

In some embodiments, the upper manifold 72 is from about 3 inches wide to about 48 inches wide, is from about 3 inches in height to about 36 inches in height, and is from about 0.03 inches in thickness, or depth, to about 0.125 inches in thickness, for example. In turn, the lower manifold 74 is from about 1 inches in height to about 3 inches in height; is from about 0.25 inches in thickness to about 2 inches in thickness; and is from about 3 inches wide to about 48 inches wide, for example, although a variety of dimensions are contemplated.

As shown in FIG. 10, the inner face 92 of the first frame member 30 is abutted against the first intermediate seal 38, and the inner face 122 of the second frame member 32 is abutted against the second intermediate seal 46. In some embodiments, the outer perimeters of the first and second frame members 30, 32; the first and second intermediate seals 38, 46; the first and second spacers 40, 48; the first and second plates 52, 54; and the inner seal 58 each are substantially aligned with one another. In particular, the fastener holes 98, 128 (FIG. 2) of the first and second frame members 30, 32; the fastener holes 147, 147B of the first and second intermediate seals 38, 46; the fastener holes 159, 159B of the first and second spacers 40, 48; and the fastener holes 208 of the inner seal 58 are all aligned with one another such that the plurality of fasteners 70 are inserted through corresponding fastener holes to secure the burner assembly 18 together.

The connector 62 is secured to the opening 102 of the first frame member 30. In particular, the flange 212 (FIG. 2) is secured to the outer face 90 to place the connector 62 in communication with the lower manifold 74 (FIG. 10) and, thus, the upper manifold 72. The igniter 66, or ignition device, is mounted to the pair of tabs 101 of the first frame member 30 adjacent the gap 242 and is adapted to ignite combustible gases emanating from the gap 242. In other embodiments, however, the igniter 66 or an additional or alternate ignition device is mounted in the path of combustible gases into the burner assembly 18 prior to the gases entering the burner assembly 18 such that flames 22 travel up into the upper manifold 72 and/or lower manifold 74. For example, in some embodiments, the igniter 66 is optionally mounted in the path of gas flow between the gas source 16 and the lower manifold 74. The flames 22 are viewable in the upper manifold 72 through the first and second plates 52, 54 according to some embodiments.

As shown in FIG. 1, positioning of the burner assembly 18 in the fireplace 10 according to some embodiments includes releasably securing the feet 100 (FIG. 3) and 130 (FIG. 4) of the burner assembly 18 into a lower portion of the combustion chamber 14 such that the burner assembly 18 is substantially vertically oriented. In some embodiments, the burner assembly 18 is positioned in the fireplace 10 such that the top edges 184, 184B of the first and second plates 52, 54 are disposed generally at a middle portion 300 of fireplace 10, such that the first and second plates 52, 54 are exposed through a transparent portion 24 of the fireplace 10 while a remainder of the burner assembly 18 is substantially hidden from view by a surrounding, non-transparent portion 24B of the fireplace 10.

The connector 62 is placed in communication with the gas source 16, including any flow regulators, means for varying air-to-gas mixture ratios, or other equipment feeding the burner assembly 18 through the connector 62.

Where the first and second plates 52, 54 (FIG. 2) are substantially transparent, the visibility of the burner assembly 18 is greatly reduced, such that the burner assembly 18 is substantially hidden from view. For example, where the first and second plates 52, 54 are formed of a substantially clear material, light is able to pass through the a central viewing area 88, into the first and second plates 52, 54, and out through the central viewing area 88B.

In some embodiments, this lends an appearance that a source of the flames 22 is substantially hidden. This hidden-source feature is useful in various scenarios, including creating a more realistic look with a log set or an eye-catching visual effect like that generally shown in FIGS. 1 and 12. In some embodiments, the top edges 184, 184B (FIG. 2) of the first and second plates 52, 54 define a light visual horizon with the first and second plates 52, 54 being transparent and less visible. In other embodiments, the top edges 184, 184B are not generally visible to the naked eye.

In some embodiments, the burner assembly 18 is used in a method of producing the flames 22 to produce a substantially continuous, uninterrupted body of flames 22 extending across the gap 242 at the top edges 184, 184B. In contrast to burners with a multitude of distinct holes for delivering combustible gases, the burner assembly 18 optionally provides a single, substantially thin and elongate aperture—the gap 242. In at least such manner, the gap 242 is optionally selected to provide means for forming a substantially continuous body of flames 22 across the upper portion of the burner assembly 18. It should also be understood that a spacing, length, and shape (e.g., top profile) of the gap 242 is selected to provide various BTUs from the burner assembly 18 as desired.

In some embodiments, the burner assembly 18 is used to create an effect whereby the flames 22 race from the first side 26 of the burner assembly 18 to the second side 28 of the burner assembly 18. In particular, by locating the igniter 66 at the first side 26 of the burner assembly 18 the flames 22 start at the first side 26 and travel to the second side 28. In still other embodiments, an additional igniter 66 is placed at the second side 28 of the burner assembly 18 to provide further versatility in a direction the flames 22 travel across the gap 242 (e.g., left-to-right, right-to-left, and/or meeting-in-the-middle effects).

Figure 12:
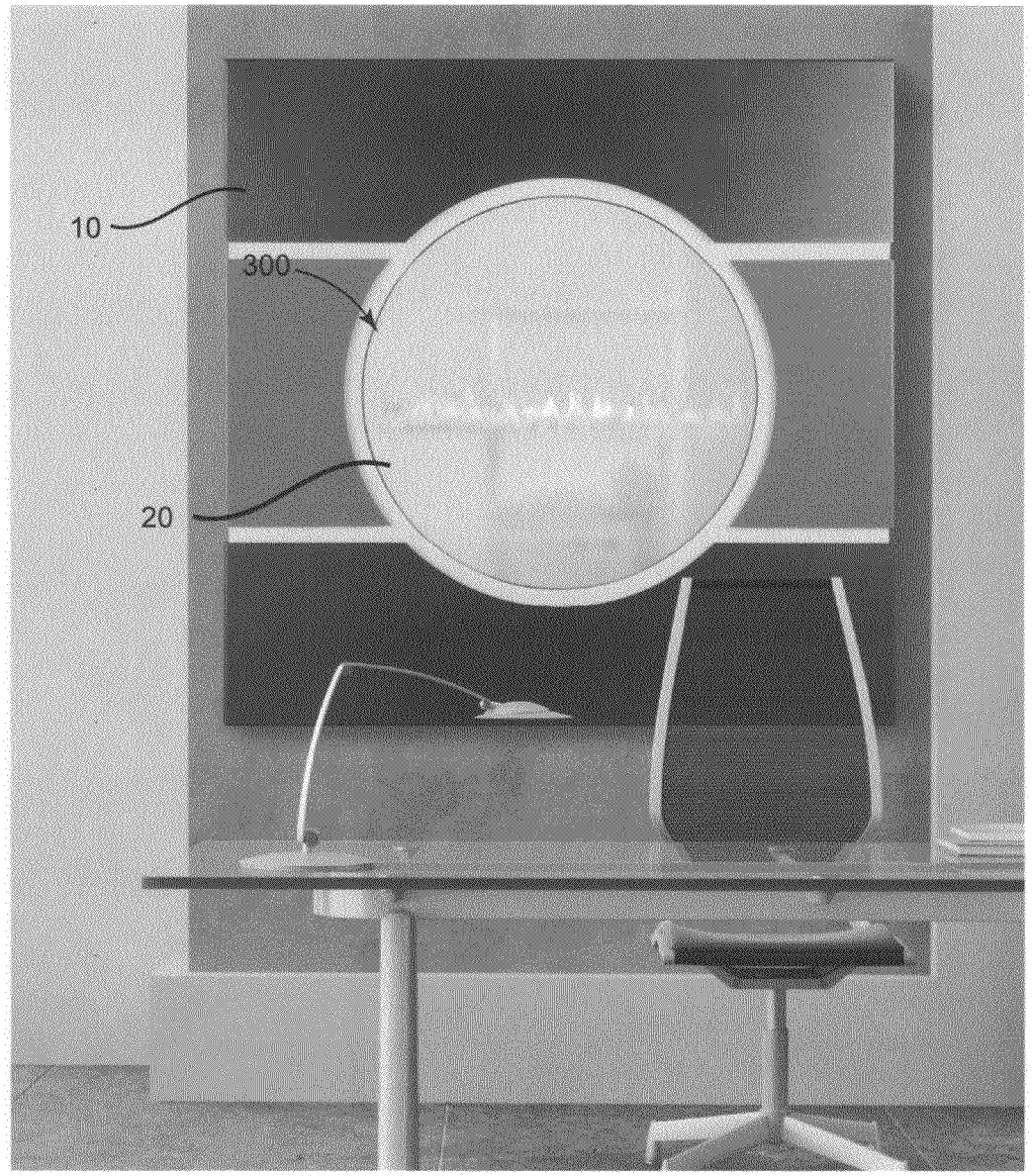
FIG. 12 is a front view of the fireplace of FIG. 1 installed in a wall, according to some embodiments.

FIG. 12 is a front view of the fireplace 10 illustrating one visual effect accomplished according to various embodiments—a see-through effect where the burner 18 is substantially see-through and hidden from view. As shown in FIG. 12, a viewer (not shown) is able to see into the combustion chamber 20, through the fireplace 10 (including the burner 18), and to the other side of the fireplace 10. The visual impact of the burner 18 (FIG. 1) is substantially reduced such that the burner 18 is substantially hidden and the flames 22 "appear in mid-air." From this description, a variety of variations and augmentations of such see-through viewing effects should become apparent.

Figure 13:
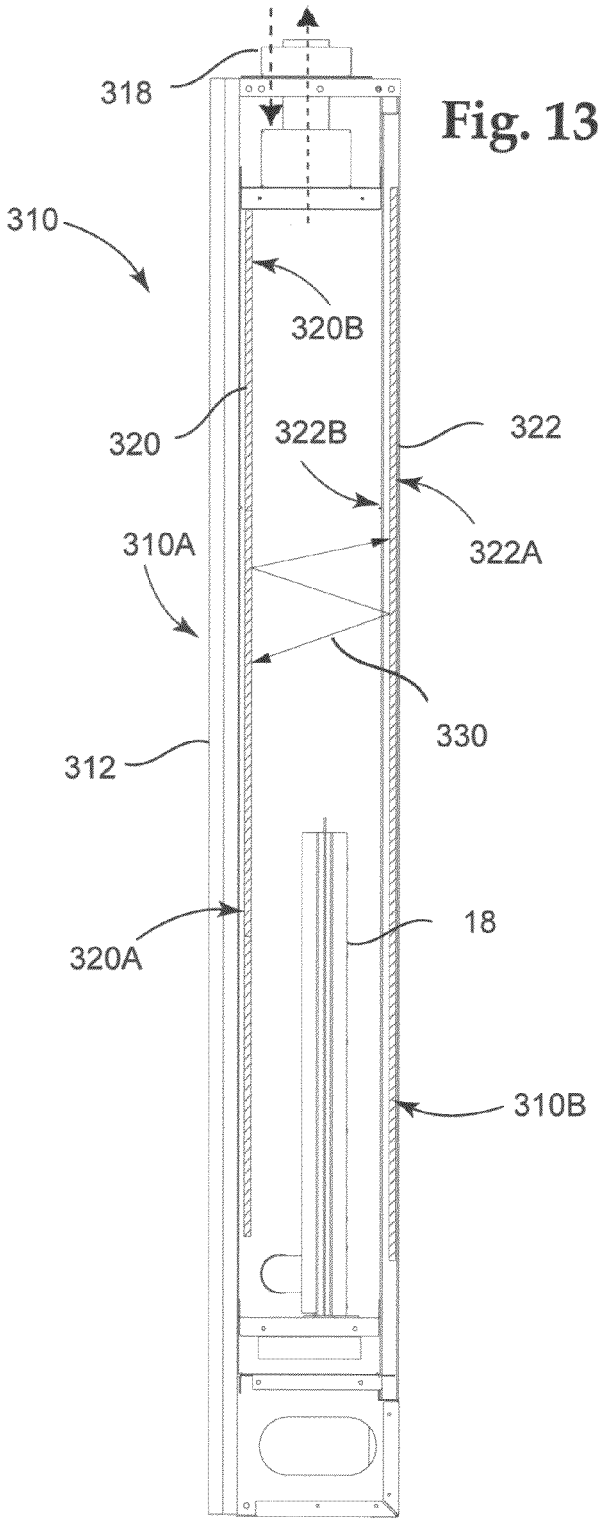
FIG. 13 is a side, cut away view of another fireplace, according to some embodiments.

FIG. 13 is a side view of another fireplace 310, according to some embodiments. In various embodiments, features described in association with the fireplace 10 and the fireplace 310 are interchangeable as desired. In some embodiments, the fireplace 310 includes a housing 312, a vent assembly 318, a front panel 320, a rear panel 322, and the burner assembly 18. In some embodiments, a viewer is able to view fireplace flames (not shown) by looking into the fireplace 310 from a first side 310A and/or a second side 310B of the fireplace, where the at least one of the front and rear panels 320, 322 allow viewing into the fireplace 310.

As shown, the fireplace 310 has a substantially thin profile, although wider, more traditional fireplace designs are contemplated. In some embodiments the fireplace 310 includes features for creating reflective visual effects. For example, one or both of the front and rear panels 320, 322 are optionally formed of a reflective material, such as a one-way reflective material (e.g., Mirropane™ materials available from Toledo—Pilkington North America Inc. of Toledo, Ohio).

In some embodiments, the front panel 320 includes an outer surface 320A and in inner surface 320B, the front panel 320 being reflective at the inner surface 320B and allowing viewing into the fireplace 310 through the outer surface 320B. In some embodiments, the rear panel 322 includes an outer surface 320A and an inner surface 320B having substantially similar properties, where the outer surface 322A allows viewing into the fireplace 310 and the inner surface 322B provides reflective properties. As shown, the inner surfaces 320B, 322B of the front and rear panels 320, 322 are oriented inwardly, toward one another and the outer surfaces 320A, 322B face away from one another.

In some embodiments, light from fireplace flames generated by the burner 18 (not shown) is reflected back and force by the reflective inner surfaces 320B, 322B as represented by the arrow 330 to create a reflective visual effect, such as an "infinity effect." In particular, in some embodiments, the fireplace 310 is adapted to create an illusion of depth using the infinity effect, where to a viewer it appears there are a series of layers of flames emanating from within the fireplace 310 due to the repeated reflection of the flames by the inner surfaces 320B, 322B. Thus, one method of presenting fireplace flames to a user for viewing includes optically reflecting flames to create the illusion of a plurality of flames within the fireplace 310 that are not otherwise actually present. In some embodiments, the optical effect shifts and moves depending on the viewer's viewing angle. Additionally, the inner surfaces 320B, 322B are optionally substantially parallel with one another, or can be angularly offset to vary a generated optical, or visual effect as desired.

Viewing panels having reflective properties can be utilized to achieve a variety of other, additional or alternative effects. For example, in some other embodiments, one or both of reflective surfaces 320B, 322B are oriented outwardly, toward a user, and the front and/or rear panels 320, 322 are adapted such that when turned off, a viewer sees an external, reflective surface substantially similar to a mirror, for example. When turned on, however, the front and/or rear panels 320, 322 become substantially see-through due to the internal light generated by the flames, allowing viewing of the flames generated in the fireplace 310. Thus, in one method of using the fireplace 310, the interior of the fireplace 310 is substantially obscured from view as desired (e.g., when not in operation) and, for example, even though a room in which the fireplace 310 is installed is illuminated.

Figure 14:
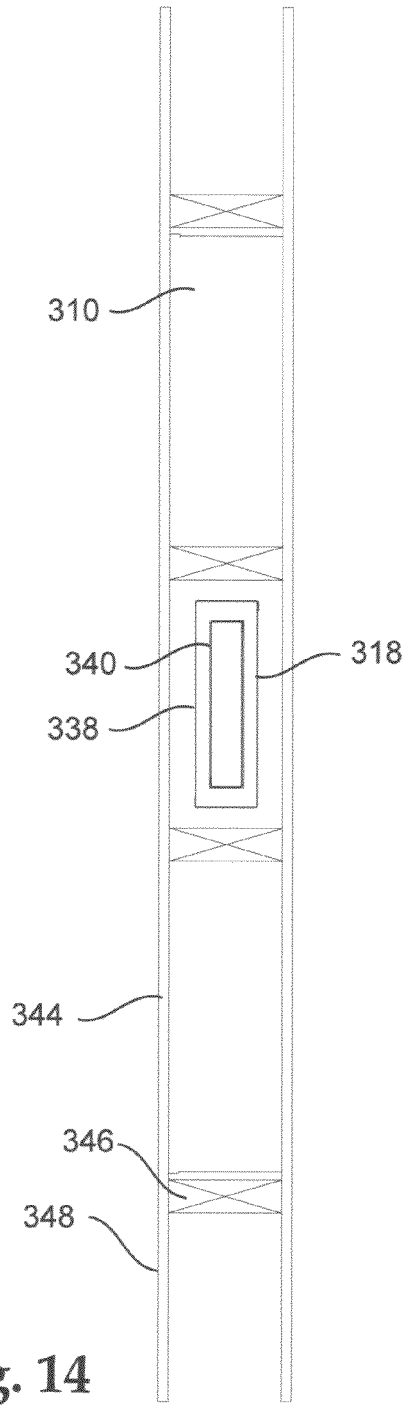
FIG. 14 is a top view of a fireplace of FIG. 13 installed in a wall, according to some embodiments.

FIG. 14 is a top view of the fireplace 310, according to some embodiments, where the vent assembly 318 includes an outer duct member 338 and an inner duct member 340 centrally disposed within the outer duct member 338. Although in FIG. 13, the vent assembly 318 is shown as being cut off, the vent assembly 318 optionally includes a short, vent connector secured to the fireplace 310 as well as a longer run of associated duct work having a substantially similar configuration to that of the vent connector (inner and outer duct members having similar sizes and shapes to that of the vent connector).

In some embodiments, the vent assembly 318 is particularly useful for installation in a relatively thin wall 344. Generally, the wall 344 is formed by a plurality of structure members 346 (e.g., wall studs) and appropriate facing members 348 (e.g., dry wall). The outer and inner duct members 338, 340 are substantially rectangular in shape, helping to allow the outer profile of the vent assembly 318 to be reduced while retaining sufficient air flow space (e.g., relative to traditional, round vent assembly designs). In particular, the outer and inner duct members 338, 340 each define a substantially thin rectangular profiles and are secured relative to one another to form an air gap between them. In some embodiments, the air gap between the outer and inner duct members 338, 340 acts as a plenum for supplying fresh air into the fireplace 310 and the inner duct 340 provides a plenum for taking exhaust air out of the fireplace 310, the vent assembly 318 being in communication with a combustion chamber of the fireplace 310 and air supply plenum(s) of the fireplace 310.

In some embodiments, the vent assembly 318 is adapted to be installed in wall 344 having an open interior about 5.5 inches wide, for example, such as that formed using a standard 2 inch×6 inch wall stud configuration. In particular, the dimensions of the outer duct 338 and inner duct 340 are selected to allow sufficient spacing between structure members 346 and facing members 348 of the wall 344 to prevent overheating or address other building and safety concerns, while providing sufficient air flow into and out of the fireplace 310.

In view of the foregoing, in some embodiments the fireplace 10 is optionally substantially thin, overall, and installed in a standard wall 344 (e.g., a 2×6 stud wall) with the narrow vent assembly 318 being hidden within the wall 344. If desired, the fireplace 10 includes the middle portion 300 of the fireplace being substantially transparent from-front to-back, as well as the first and second plates 52, 54 being substantially transparent, such that the fireplace 10 provides a viewing window through the wall 344 that is at least largely unobscured by the burner assembly 18 as shown in FIG. 12.

Figure 15:
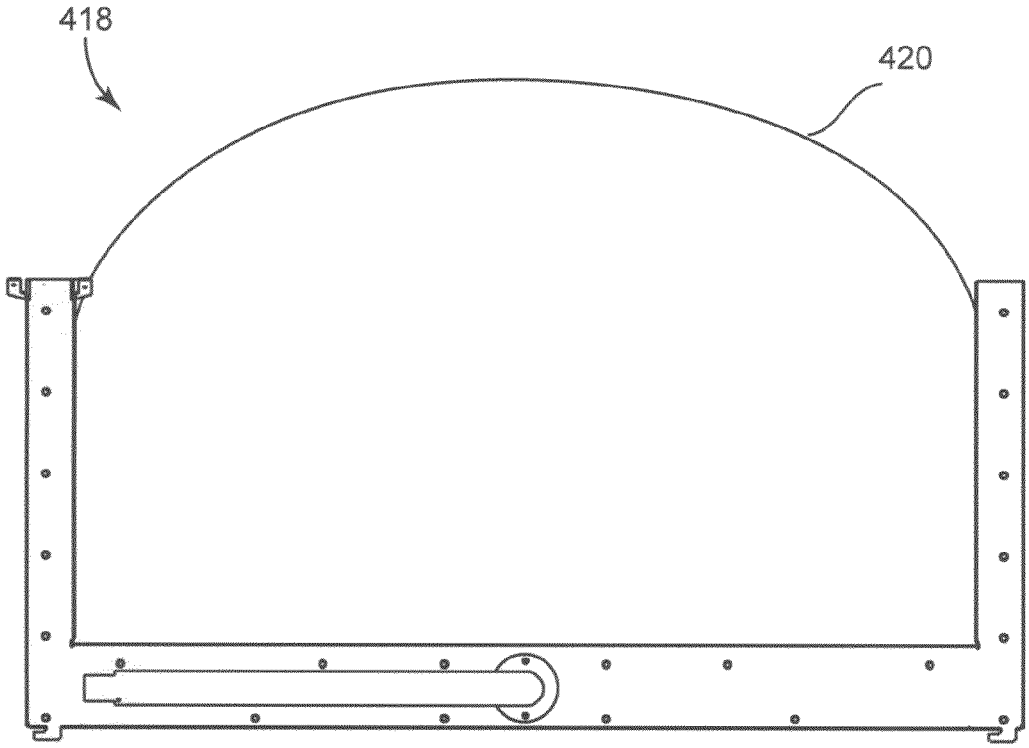
FIG. 15 is a front view of another burner assembly, according to some embodiments.

Although some examples of flame effects and fireplace installations and configurations have been described, it should be understood a variety of different effects, configurations, and combinations thereof are contemplated. Additionally, although the burner assembly 18 is shown and described with substantially rectangular first and second plates 52, 54, in other embodiments the plates 52, 54 take a variety of shapes. For example, another burner assembly 418 is shown in FIG. 15 having substantially arcuately shaped plates (only a first plate 420 is visible in FIG. 15). Moreover, the frame members and seals, though described and shown according to some embodiments as substantially U-shaped can take a variety of shapes and forms as appropriate.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What is claimed is:

1. A gas burner assembly comprising:

a first sheet having an inner face, an outer face, and extending between a first edge and a second edge opposite the first edge;

a second sheet having an inner face, an outer face, and extending between a first edge and a second edge opposite the first edge, the first and second sheets being secured relative to one another such that the first and second sheets are separated by a gap that defines a substantially thin manifold between the inner faces of the first and second sheets, where an outlet from the substantially thin manifold is formed along the second edge of the first sheet;

a conduit in communication with the manifold, the conduit being adapted for connection to a source of gas;

a first frame including a first member, a second member, and a lateral member extending between the first and second members, the first member, the second member, and the lateral member defining a central viewing area, wherein the conduit is a tubular member and the first frame includes an opening in communication with the substantially thin manifold and the tubular member; and a second frame including a first member, a second member, and a lateral member extending between the first and second members, the first member, the second member, and the lateral member of the second frame defining a central viewing area, wherein the first frame is secured adjacent the outer face of the first sheet such that the first sheet is exposed through the central viewing area in the first frame and the second frame is secured adjacent the outer face of the second sheet such that second sheet is exposed through the central viewing area in the second frame.

2. The assembly of claim 1, wherein the first and second sheets are formed of substantially transparent material.

3. The assembly of claim 1, wherein the first and second sheets are formed of glass material.

4. The assembly of claim 1, wherein the gap is from about 0.03 to about 0.125 inches thick.

5. The assembly of claim 1, wherein the gap is less than about 0.5 inches thick.

6. The assembly of claim 1, wherein the outlet has a length greater than about 3 inches.

7. The assembly of claim 1, wherein the conduit is further adapted for connection to a source of air and to mix gas from the gas source with air from the air source at a selected ratio.

8. The assembly of claim 1, wherein the substantially thin manifold is substantially vertically oriented.

9. The assembly of claim 1, wherein the outlet is formed along the second edges of both the first and second sheets.

10. A gas burner assembly comprising:

a first sheet having an inner face, an outer face, and extending between a first edge and a second edge opposite the first edge;

a second sheet having an inner face, an outer face, and extending between a first edge and a second edge opposite the first edge, the first and second sheets being secured relative to one another such that the first and second sheets are separated by a gap that defines a substantially thin manifold between the inner faces of the first and second sheets, where an outlet from the substantially thin manifold is formed along the second edge of the first sheet;

a conduit in communication with the manifold, the conduit being adapted for connection to a source of gas;

an inner seal comprising a first side portion, a second side portion, and a lateral portion, the first and second side portions abutting the inner faces of the first and second sheets and the lateral portion and the first edge of the second sheet together defining a first opening into the substantially thin manifold; and a first intermediate seal comprising a first side portion, a second side portion, and a lateral portion, the lateral portion defining a second opening in communication with the first opening, the first intermediate seal being abutted against the outer face of the first sheet.

11. The assembly of claim 10, further comprising a first spacer receiving the first sheet and being abutted against the first intermediate seal, the first intermediate seal and the first spacer combining to form the second opening.

12. The assembly of claim 10, wherein the substantially thin manifold defines a width and a depth, and further wherein the first opening formed by the inner seal and the second opening formed by the first intermediate seal combine to define a lower manifold positioned below, and in fluid communication with the substantially thin manifold formed by the gap between the first and second sheets, the lower manifold extending along a substantial portion of the width of the substantially thin manifold.

13. The assembly of claim 12, wherein the lower manifold extends across substantially all of the width of the substantially thin manifold.

* * * * *